United States Patent [19]

Wilcox

[11] 4,360,145

[45] Nov. 23, 1982

[54] DIE-CUT PACKING PAD

[75] Inventor: John F. Wilcox, Pinson, Ala.

[73] Assignee: Champion International Corporation, Stamford, Conn.

[21] Appl. No.: 189,094

[22] Filed: Sep. 22, 1980

[51] Int. Cl.[3] ..... B65D 81/02

[52] U.S. Cl. ..... 229/1.5 R; 206/521; 206/586; 206/594

[58] Field of Search ..... 229/23 R, 23 A, 23 AB, 229/23 BT, 23 C, 1.5 R, DIG. 1, DIG. 4; 220/416, 445; 206/320, 521, 585, 586, 587, 588, 589, 590, 591, 592, 594, 319, 317, 453

[56] References Cited

U.S. PATENT DOCUMENTS

| | | | |
|---|---|---|---|
| 3,333,757 | 8/1967 | Strauss | 206/521 |
| 4,008,804 | 2/1977 | Poggiali | 206/320 |
| 4,130,199 | 12/1978 | Sorenson | 206/320 |

OTHER PUBLICATIONS

Handbook of Corrugated Fibreboard Boxes and Products, p. 42, 1968.

*Primary Examiner*—William Price
*Assistant Examiner*—Gary E. Elkins
*Attorney, Agent, or Firm*—Evelyn M. Sommer

[57] ABSTRACT

A corrugated, one-piece, die-cut packing pad for insertion into opposite sides of a shipping carton for cushioning and supporting a device transported in the carton and spacing and precluding movement of the device relative to the sidewalls of the carton. The pad has a central, substantially solid front panel inserted between the transported device and a sidewall of the carton and a plurality of relatively pivotable, upright, hinged posts attached to opposite side edges of the front panel which when folded relative to each other in accordian style contact the sidewalls of the carton and serve to clamp the device between the front panels of the pads inserted between the opposite sidewalls of the carton and the device. A top panel is hinged to spaced portions of the top of the front panel and foldable 90° relative thereto to overlie the device during shipment to provide cushioning for the top of the device during shipment.

14 Claims, 8 Drawing Figures

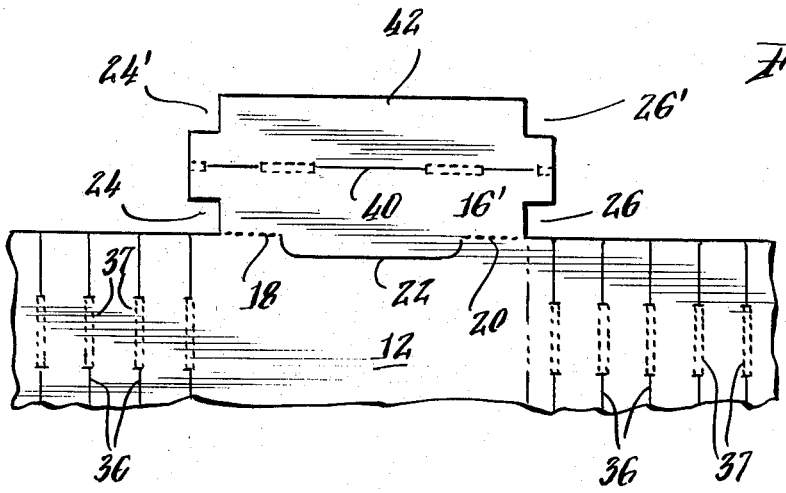
Fig. 7.
Fig. 8.
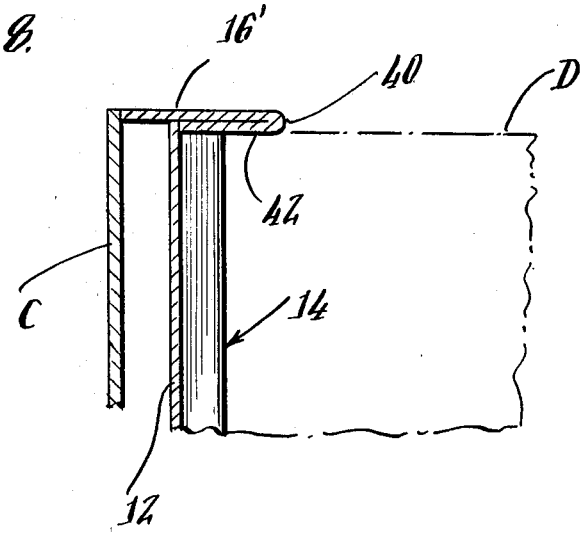

DIE-CUT PACKING PAD

BACKGROUND AND SUMMARY OF THE INVENTION

This invention relates to a corrugated paperboard, die-cut packing pad adapted to be inserted in a shipping carton between the sidewalls of the carton and a device shipped in the carton to protect the device during shipment.

It is common practice to protect a device shipped in a carton against damage by precluding movement of the device in the shipping carton and contact with the sidewalls of the carton. This is usually accomplished by placing packaging material such as straw, polystyrene, paper or corrugated board between the shipped device and the interior sidewalls of the carton to cushion shocks imparted to the carton during handling and to preclude movement of the device relative to the carton sidewalls. The necessity of providing and inserting such packing material in multiple units increases the cost of handling the device as well as the cost of material and warehouse inventory of packing material.

This invention relates to a one-piece, die-cut packing pad which can be folded in a simple operation and inserted between the sidewalls of a carton and a device shipped in the carton to provide protection to all sides of the device during shipment. The pad has a central, substantially solid front panel inserted between the transported device and a sidewall of the carton and a plurality of relatively pivotable, upright, hinged posts attached to opposite side edges of the front panel which when folded relative to each other in accordian style contact the sidewalls of the carton and serve to clamp the device between the opposite sidewalls of the carton. A top panel is hinged to spaced portions of the top of the front panel and foldable 90° relative thereto to overlie the device during shipment. The front panel can also include wherever necessary, cut-outs or openings to accommodate protrusions on the shipped device, such as door handles, valves, hose connections, etc.

BRIEF DESCRIPTION OF THE DRAWINGS

Further objects and advantages of the invention will become apparent from the following description and claims, and from the accompanying drawings, wherein:

FIG. 7 is a partial plan view illustrating a modified top panel for use in the blank of FIG. 1; and FIG. 8 is a view illustrating the manner of folding of the modified top panel for providing an additional cushion for the top of the shipped device.

DETAILED DESCRIPTION OF THE PREFERRED EMBODIMENT

Figure 5:
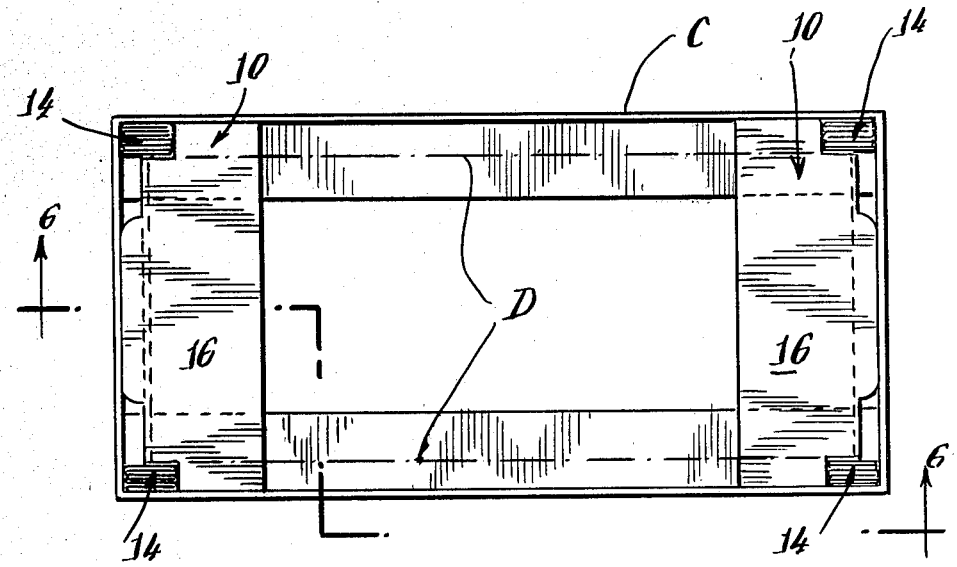
FIG. 5 is a top plan view of a pair of the pods of the present invention inserted into a carton to provide a cushion and a support for a device during shipment.
Figure 6:
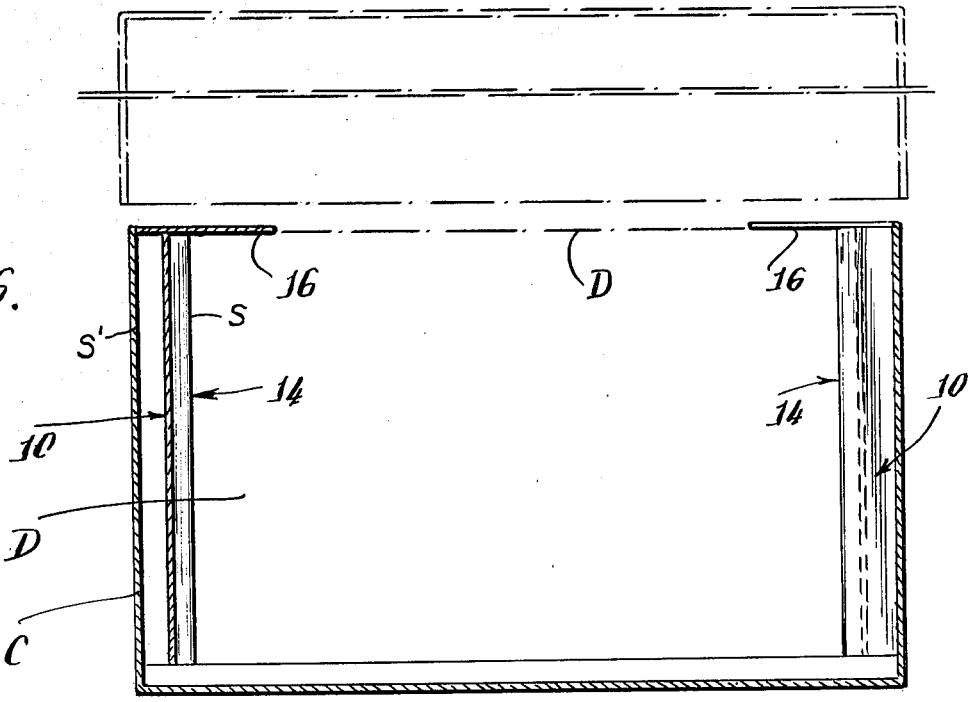
FIG. 6 is a cross-sectional view taken substantially along the plane indicated by line 6—6 of FIG. 5.

Referring now to the drawings in detail wherein like numerals indicate like elements throughout the several views, and particularly FIGS. 5 and 6, a pair of die-cut pads 10 constituting the subject of the present invention are adapted to be inserted between the opposed sidewalls S and S' of a carton C and a device D, for example, an air conditioning unit, adapted to be shipped in carton C to protect the device D during shipment by precluding movement of the device D relative to sidewalls S and S' and to cushion the device D against shocks received by carton C.

Each pad 10 includes a substantially solid front wall 12 hingedly connected along opposite edges to a plurality (herein four) of upright, hinged posts 14 folded relative to each other in accordian style. Each of the outermost posts 14 of each set are of equal width and have a greater width than the first posts 14 in each set so as to space the front wall 12 of each pad 10 from the respective, adjacent sidewall S or S' and to clamp the device D between the opposed front wall 12 of each pad 10. The corrugated posts 14 will absorb any shock transmitted to the carton sidewalls S and S' and preclude movement of device D relative to sidewalls S and S'.

A top panel 16 is hinged along spaced, co-linear score lines 18 and 20 to the top edge of front panel 12 of each pad 10 and die-cut along line 22 so as to be foldable 90° relative to the front panel to overlie the device D during shipment to provide cushioning for the top of the device D during shipment. The inner, opposed corners of top panel 16 include rectangular cut-outs 24, 26 to accommodate and receive the folded panels forming upright posts 14. Furthermore, front panel 12 can include wherever necessary, cut-outs or openings 28 to accommodate protrusions on device D, such as door handles, valves, hose connections and the like.

Figure 1:
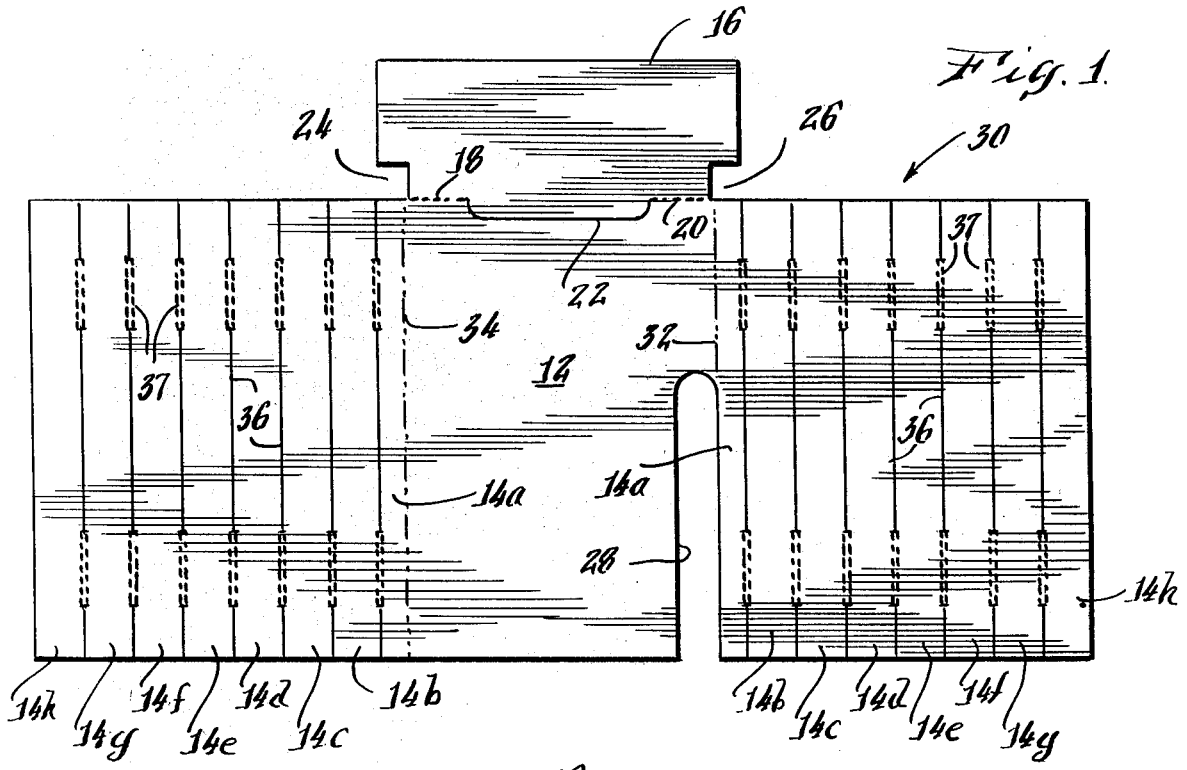
FIG. 1 is a plan view of a blank for forming the pad of the present invention.
Figure 2:
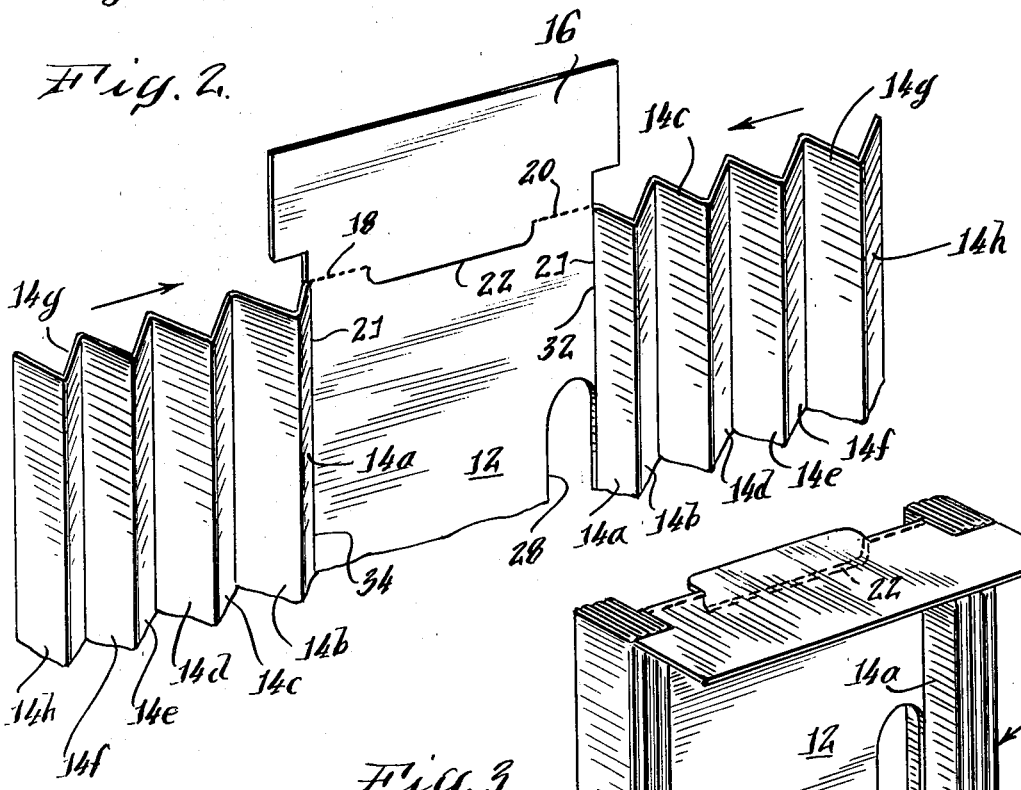
FIGS. 2 and 3 are perspective views illustrating the folding of the blank of FIG. 1 into the pad of the present invention.
Figure 3:
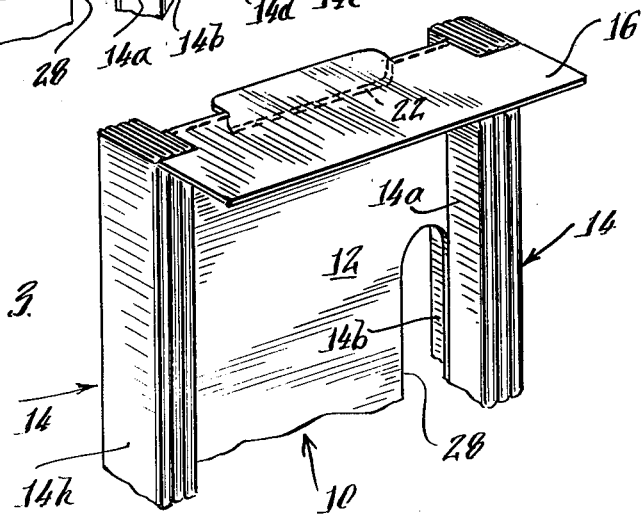
Figure 4:
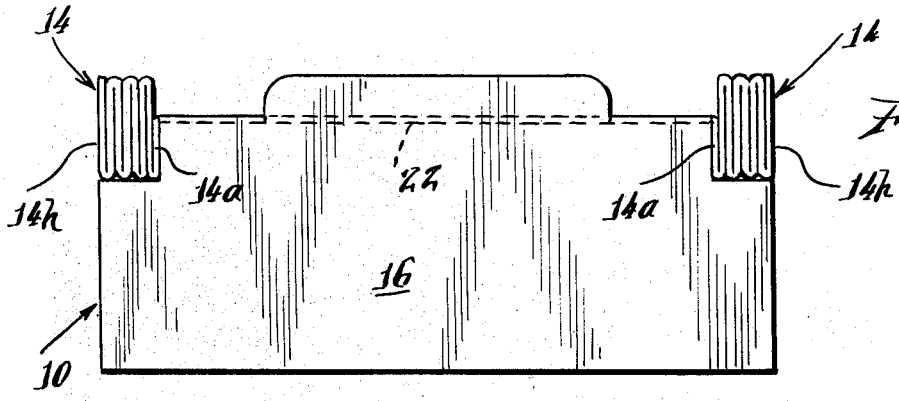
FIG. 4 is a top plan view of the pad of the present invention.

Each pad 10 is formed from a unitary, corrugated paperboard blank 30 illustrated in FIG. 1, which is simply folded as shown in FIGS. 2 and 3 and inserted in carton C between sidewalls S or S' and device D.

Blank 30 includes the substantially rectangular front panel 12 having a cut-out 28 extending along one side edge 32 of panel 12. Hingedly coupled to opposed side edges 32 and 34 of front panel 12 by a score line 21 are first posts panels 14*a*. Coupled by double score lines 37 spaced along vertical cut lines 36 to each panel 14*a* are successive post panels 14*b*, 14*c*, 14*d*, 14*e*, 14*f*, 14*g* and 14*h*. Each of the post panels 14*b*–14*h*, inclusive, are of equal width, which width is greater than the width of first post panel 14*a*.

Die-cut along line 22 and hinged along spaced score lines 18 and 20 to the top edge of front panel 12 is top panel 16, provided with substantially rectangular corner cut-outs 24, 26.

As shown in FIGS. 2 and 3, in order to form pad 10 from blank 30, after the front panel 12 is inserted between sidewall S or S' and device D in carton C, the post panels 14*a* are simply folded inwardly about respective edges 32, 34, 90° relative to front panel 12 and the remaining panels 14*b*–14*h*, inclusive, connected to each panel 14*a* folded 180° relative to each other and panel 14*a* in accordian style to form the four upright, corrugated posts 14. Top panel 16 can then be folded 90° relative to front panel 12 in a plane perpendicular to posts 14 about hinges or score lines 18 and 20 to overlie device D. The posts 14 fit snuggly into cut-outs 24, 26, respectively, on opposite sides of top panel 16.

The bursting strength of the corrugated board of pad 10 may be selected on an individual basis. Further, all fold score lines may be replaced by perforated score lines and the board coated with a suitable non-abrasive, if desired.

The top panel 16 may also contain one or more hinges or score lines 40 as illustrated in FIGS. 7 and 8 so as to fold back upon itself to create a multiple thickness if further top cushioning is desired. In this instance, the outer, opposed corners of top panel 16 include cut-outs 24' and 26' which will complement corners 24 and 26 to receive posts 14. The top panel 42 can in this instance be folded about hinge or score lines 40 to overlie device D in a reinforced construction.

What is claimed is:

1. A packing pad comprising:

a front panel having opposed side edges and a top edge, a plurality of upright posts hingedly connected to each of the opposed side edges of said front panel and foldably coupled to each other in accordian style, each of said posts occupying a plane substantially perpendicular to said front panel, and a top panel hingedly coupled to the top edge of said front panel extending inwardly from said front panel in a plane substantially perpendicular to said front panel and said upright posts wherein said top panel includes a substantially rectangular cut-out in each corner thereof adjacent the top edge of said front panel receiving therein the upright posts coupled to the opposed side edges of said front panel.

2. The pad of claim 1 wherein said front panel, upright posts and top panel are formed from corrugated paperboard.

3. The pad of claim 1 wherein the width of at least some of said posts is greater than the width of each of said cut-outs.

4. The pad of claim 3 wherein at least a portion of said first upright post connected to each of said side edges of said front panel is approximately the same width as each of said cut-outs.

5. The pad of claim 1 wherein said front panel includes at least one opening therein.

6. The pad of claim 1 wherein said upright posts are hingedly coupled to each other by double fold lines spaced along cut lines defining opposite edges of said posts.

7. A unitary, planar, paperboard blank for forming the pad of claim 1.

8. A unitary, planar, paperboard blank for forming the pad of claim 2.

9. A unitary, planar, paperboard blank for forming the pad of claim 3.

10. A unitary, planar, paperboard blank for forming the pad of claim 4.

11. A unitary, planar, paperboard blank for forming the pad of claim 5.

12. A unitary, planar, paperboard blank for forming the pad of claim 6.

13. A paperboard blank for forming a packing pad comprising:

a substantially rectangular central panel having opposed side edges and a top edge, a plurality of side rectangular panels hingedly coupled to each of the opposed side edges of said central panel and to each other, and a substantially rectangular top panel hingedly connected along spaced fold lines to the top edge of said central panel, said fold lines being spaced by a cut line, wherein the opposed lower corners of said top panel include rectangular cut-outs.

14. A blank in accordance with claim 13 wherein the first side rectangular panel coupled to each side edge of said central panel has a smaller width than the remainder of said side rectangular panels coupled to it, and the remainder of said side rectangular panels being of substantially equal width.

* * * * *